US008322351B2

(12) United States Patent
Ott

(10) Patent No.: US 8,322,351 B2
(45) Date of Patent: Dec. 4, 2012

(54) THERMOPLASTIC HAIR CONNECTING ELEMENTS

(75) Inventor: Gerhard Ott, Graz (AT)

(73) Assignee: Bege Privatstiftung, Vienna (AT)

( * ) Notice: Subject to any disclaimer, the term of this patent is extended or adjusted under 35 U.S.C. 154(b) by 423 days.

(21) Appl. No.: 11/974,099

(22) Filed: Oct. 10, 2007

(65) Prior Publication Data

US 2008/0202543 A1 Aug. 28, 2008

(30) Foreign Application Priority Data

Feb. 23, 2007 (AT) ..... A 293/2007

(51) Int. Cl.
*A41G 3/00* (2006.01)
*A41G 5/00* (2006.01)

(52) U.S. Cl. ..... 132/53; 132/201

(58) Field of Classification Search ..... 132/201, 132/53–56; 428/122
See application file for complete search history.

(56) References Cited

U.S. PATENT DOCUMENTS 3,200,823 A * 8/1965 Sebastian ..... 132/216
3,533,896 A * 10/1970 Hartig ..... 428/122
2004/0170805 A1* 9/2004 Ott ..... 428/122

FOREIGN PATENT DOCUMENTS

AT 403 427 2/1998
AT 412 141 10/2004

* cited by examiner

*Primary Examiner* — Robyn Doan
(74) *Attorney, Agent, or Firm* — Lucas & Mercanti, LLP; Klaus P. Stoffel

(57) ABSTRACT

A thermoplastic hair connecting element is composed of an essentially prismatic body, wherein ends of replacement or extension hair can be embedded in the hair connecting element so as to extend in a longitudinal direction of the element. The hair connecting element has at least one free surface with a profiling extending inclined relative to the longitudinal direction of the element.

1 Claim, 1 Drawing Sheet

THERMOPLASTIC HAIR CONNECTING ELEMENTS

BACKGROUND OF THE INVENTION

1. Field of the Invention

The present invention relates to a thermoplastic hair connecting element comprised of an essentially prismatic body in which in the longitudinal direction thereof the ends of extension hairs can be embedded.

2. Description of the Related Art

Various types of hair connecting elements of the above-described type are known in the art. Mist frequently used are those having a U-shaped configuration, as shown, for example, in AT 403 427 B or AT 412 141 B, wherein the ends of extension hairs are embedded in the webs of the U-shaped sections in order to obtain extension hair strands that can be fastened to the natural hair by hot melding using the connecting element. In this process, a hair strand is placed between the legs of the U-section and the hair strand is then squeezed together with heating tweezers. In order to ensure the guidance and alignment of the natural hair strands and to have sufficient adhesive material available, it has already been proposed, for example, in AT 412 141 B, to provide additional longitudinal walls and/or transverse walls between the legs of the U-section. However, such a hair connecting element is relatively complicated. Therefore, it was desirable to look for simpler solutions.

SUMMARY OF THE INVENTION

It is the object of the present invention to provide a thermoplastic hair connecting element with a configuration which is as simple as possible which, however, is not inferior to known hair connecting elements with respect to its operation.

In accordance with the present invention, the above-described object is met in a thermoplastic hair connecting element of the above-described type by providing on at least one free surface of the element at least one profiling which extends inclined relative to the longitudinal extension of the element. The profiling may be, for example, undulations, grooves or the like.

The configuration of the hair connecting element according to the present invention is much simpler than all previously known connecting elements because in the end only a single surface of the essentially prismatic solid body has a shape which deviates from a flat surface. The inclined profiling or profilings have the advantage that, when the connecting element is used on the human heads the natural hair strand placed in longitudinal direction in the element is surrounded better than previously by material of the connecting element during hot-meld gluing by means of heating tweezers. A more complicated configuration of the hair connecting element has become unnecessary because for hot-meld gluing always an applicator with heating devices is required which receives the hair connecting element. This ensures a guidance of the natural hair, i.e., it acts as an application aid.

In the simplest case, a single profiling may be provided which extends essentially transversely of the longitudinal direction of the element. Since it is a primary goal that the extension of the profiling deviates from the longitudinal direction of the hair connecting element, the expression "essentially transversely of the longitudinal direction" includes all angles of inclination which are greater than 0 and smaller than or equal to 45°. This special type of profiling, whether undulated or hill-shaped, or whether ribbed in the form of V shape or triangles is of secondary importance.

In a preferred embodiment, two intersecting profilings are provided. This has the advantage that even individual ends of the natural hair strand to be attached, and which may deviate from the general direction of the combed hair, still make contact essentially transversely of the profiling and, thus, are well embedded when they are squeezed during the hot-meld process.

DETAILED DESCRIPTION OF THE INVENTION

Figure 1:
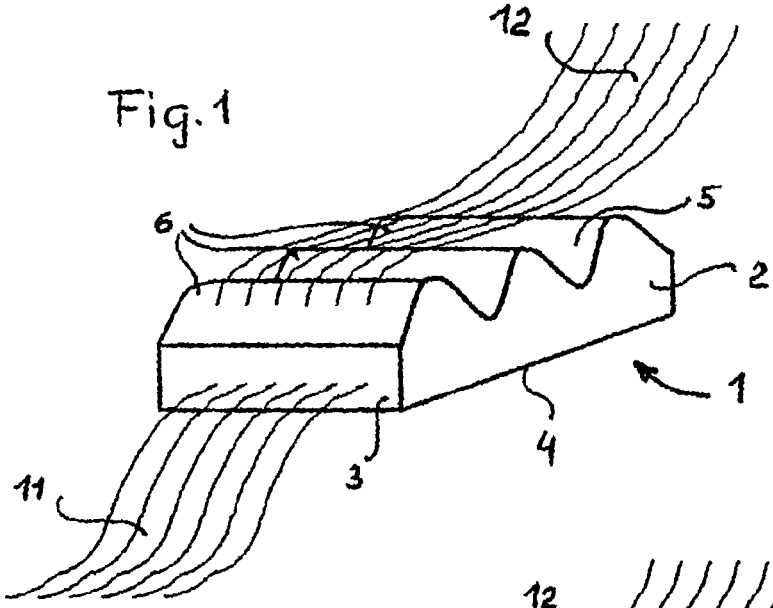
FIG. 1 is a schematic perspective view of the thermoplastic hair connecting element according to the present invention.

The thermoplastic hair connecting element 1 according to the present invention shown in FIG. 1 has an essentially prismatic solid body, for example, a parallelepiped body, whose longitudinal sides 2 and transverse sides 3 and the base side 4 are essentially smooth and flat. The free surface 5 located opposite the base side 4 has a profiling 6 extending essentially transversely of the longitudinal direction of the element. In the illustrated embodiment, the profiling is a simple undulation.

Figure 2:
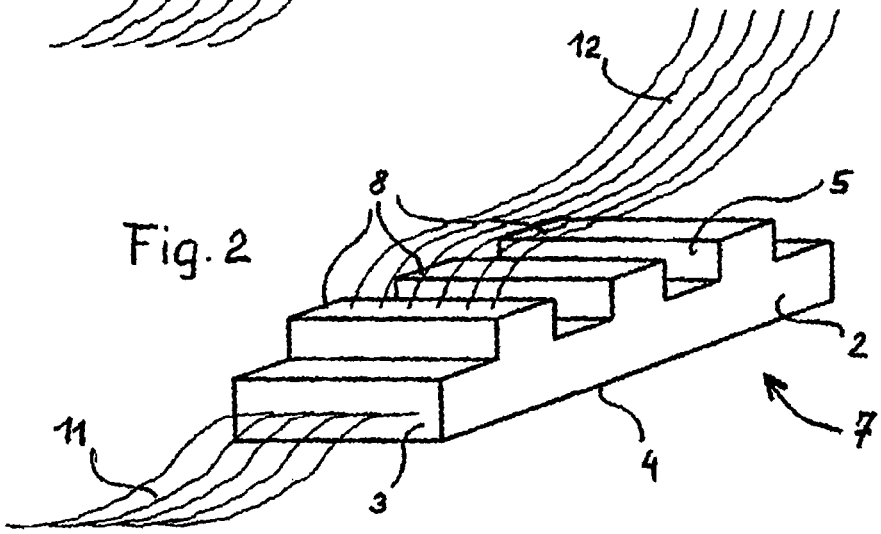
FIG. 2 is a perspective view of another embodiment of the hair connecting element.

FIG. 2 of the drawing shows a similar hair connecting element 7 in which, however, the profiling 8 is in the form of a rectangular toothing.

In general, any shape of profiling can be used in all embodiments as long as they extend "essentially transversely of the longitudinal direction", i.e. at an angle greater than 0 and smaller than or equal to 45°.

Figure 3:
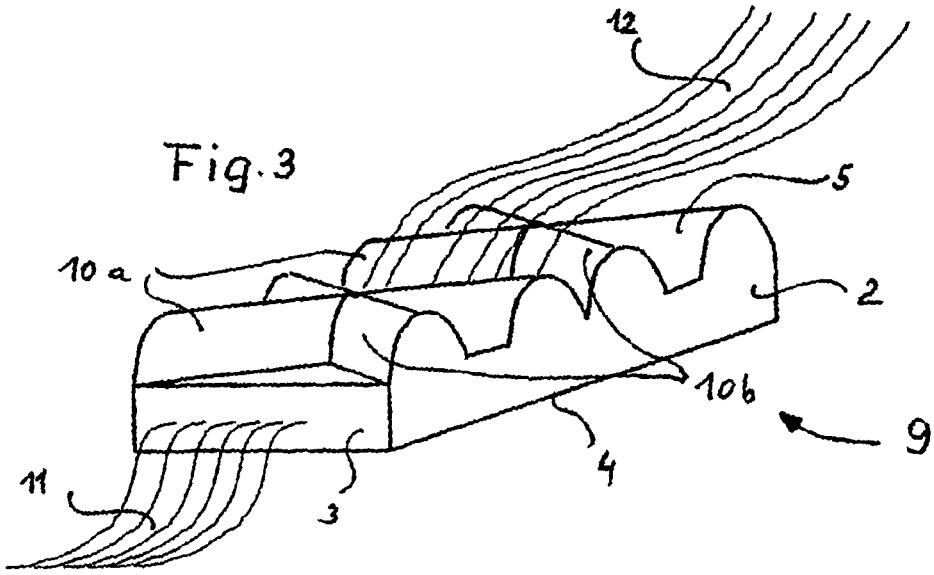
FIG. 3 is a perspective view of another embodiment of the hair connecting element with two intersecting profilings.

Finally, FIG. 3 shows a hair connecting element 9 in which two intersecting profilings 10*a* and 10*b* are provided.

In a first step of operation, the ends of replacement as extension hairs 11 are embedded in the thermoplastic hair connecting element 1, 7, or 9 which is in the molten or pasty state, wherein the hairs are aligned in the longitudinal direction, i.e., parallel to the longitudinal sides 2. The resulting bundled extension hair strands obtained at an end by the thermoplastic hair connecting element 1, 7, or 9 are picked up by heating tweezers or the like when the hair connecting element is used on the human head, and the end portions of a natural hair strand 12 is placed on the profiled free surface 5. By heating and squeezing the hair connecting element 1, 7, or 9, the ends of the natural hairs 12 are also embedded in the element, so that the extension hair 11 is connected to the natural hair 12. When the hair connecting element 1, 7 or 9 is heated and squeezed, the profilings 6, 8 or 10*a*, 10*b* of the surface 5 in relation to the location of the natural hair strands 11, have the effect that the natural hairs 11 are well surrounded by thermoplastic binder.

The material to be used for the hair connecting element 1, 7 or 9 is essentially any thermoplastic material whose melting point or softening point is not too low, so that no separation occurs when the head is washed as usual.

The size of the hair connecting element according to the present invention may be, for example, a length of about 4 to 10 mm, a width of about 2 to 5 mm, a base thickness of about 1 mm, and a profiling height of about 1 to 4 mm.

While specific embodiments of the invention have been shown and described in detail to illustrate the inventive principles, it will be understood that the invention may be embodied otherwise without departing from such principles.

I claim:

1. A thermoplastic hair connecting element consisting of an essentially rectangular prismatic solid body, wherein the body comprising transverse sides, longitudinal sides, a base side and a free surface being opposite to the base side, the free surface having inclined profilings which extend substantially transversely from one longitudinal side to the other longitudinal side of the body, at least two inclined profilings forming a V shape; ends of extension hairs are embedded to at least one end of the transverse sides as such the hairs being parallel to the longitudinal sides of the body.

* * * * *